US009926704B1

(12) United States Patent
Nowacek

(10) Patent No.: US 9,926,704 B1
(45) Date of Patent: Mar. 27, 2018

(54) ROOF PANEL SYSTEM AND HANGER METHOD FOR INSTALLATION

(71) Applicant: David Carl Nowacek, San Antonio, TX (US)

(72) Inventor: David Carl Nowacek, San Antonio, TX (US)

( * ) Notice: Subject to any disclaimer, the term of this patent is extended or adjusted under 35 U.S.C. 154(b) by 0 days.

(21) Appl. No.: 14/612,061

(22) Filed: Feb. 2, 2015

Related U.S. Application Data

(60) Provisional application No. 61/934,212, filed on Jan. 31, 2014.

(51) Int. Cl.

| | |
|---|---|
| ***E04D 1/34*** | (2006.01) |
| ***E04F 13/08*** | (2006.01) |
| ***E04D 1/26*** | (2006.01) |
| ***E04F 13/23*** | (2006.01) |

(52) U.S. Cl.
CPC ..... *E04D 1/34* (2013.01); *E04D 1/265* (2013.01); *E04F 13/0832* (2013.01); *E04F 13/23* (2013.01); *E04D 2001/3411* (2013.01); *E04D 2001/3414* (2013.01)

(58) Field of Classification Search
CPC ... E04D 1/34; E04D 2001/3411; E04D 1/265; E04D 2001/3414; E04D 2001/3458; E04D 2001/3467; E04F 13/0832; E04F 13/23; F16B 5/0685; F16B 3/04; F16B 5/125; F16B 2/248
See application file for complete search history.

(56) References Cited

U.S. PATENT DOCUMENTS

| | | | | | |
|---|---|---|---|---|---|
| 282,439 | A * | 7/1883 | Chambers | E04D 1/34 | 52/547 |
| 476,381 | A * | 6/1892 | Hawthorne | E04D 13/10 | 52/26 |
| 481,724 | A * | 8/1892 | Westover | E04D 1/34 | 411/401 |
| 505,526 | A * | 9/1893 | Hawthorne | E04D 1/34 | 52/547 |
| 623,988 | A * | 5/1899 | Contant | E04D 13/10 | 52/26 |
| 676,579 | A * | 6/1901 | Esselen | E04D 13/10 | 52/26 |
| 725,678 | A * | 4/1903 | Cullum | A47G 7/045 | 126/299 R |
| 757,285 | A * | 4/1904 | Duchemin | E04D 1/34 | 52/547 |
| 1,447,567 | A * | 3/1923 | Overbury | E04D 1/265 | 52/478 |
| 1,496,108 | A * | 6/1924 | Wilson | E04D 1/265 | 52/554 |

(Continued)

*Primary Examiner* — Charles A Fox
*Assistant Examiner* — Charissa Ahmad
(74) *Attorney, Agent, or Firm* — Eric A. Hinojosa

(57) ABSTRACT

The invention is a roof system having panels attached by battens and adjustable hangers. The hangers have a leg, a tail and a hook. The hanger is supported by a batten strip material, typically made of metal with slots. These hangers are permanently secured within the battens and are non removable once the batten is fastened to a roof deck. The hangers themselves are adjustable to different lengths by sliding them within the slot with a predetermined amount of force to accommodate staggered panel edges. This dramatically reduces the labor and costs required to install roofing panels.

20 Claims, 7 Drawing Sheets

(56) References Cited

U.S. PATENT DOCUMENTS 1,814,405 A * 7/1931 Myhre ..... E04D 1/34 52/547
1,887,426 A * 11/1932 Place ..... F16B 5/125 16/4
2,057,819 A * 10/1936 Corcoran ..... E04D 1/045 52/395
2,149,818 A * 3/1939 North ..... E04D 1/28 52/24
2,212,670 A * 8/1940 Murray ..... F16G 11/04 403/391
2,427,522 A * 9/1947 Cesery ..... E04D 1/265 52/554
2,517,122 A * 8/1950 Lockwood ..... E04D 1/34 52/547
2,728,595 A * 12/1955 Wong ..... E04B 9/003 292/197
2,753,143 A * 7/1956 Berlt ..... A47G 25/186 223/88
2,768,232 A * 10/1956 Kwake ..... H01R 4/42 174/51
3,608,261 A * 9/1971 French et al. ..... B28B 1/526 264/241
3,618,993 A * 11/1971 Platte ..... B65D 67/02 16/257
3,899,855 A * 8/1975 Gadsby ..... E04D 1/265 264/45.1
3,977,141 A * 8/1976 Peters ..... B44F 9/02 52/313
4,217,853 A * 8/1980 Davitz ..... B05B 5/082 118/500
4,718,211 A * 1/1988 Russell ..... E04D 5/142 52/409
4,864,793 A * 9/1989 Miyazaki ..... E04D 1/16 52/316
5,142,745 A * 9/1992 Setty ..... F16G 11/04 24/115 M
5,664,754 A * 9/1997 Gaenslen ..... E04B 9/006 248/300
6,052,961 A * 4/2000 Gibbs ..... E04D 1/16 52/518
6,125,592 A * 10/2000 Hickey ..... E04D 1/045 52/543
6,983,571 B2 * 1/2006 Felton ..... E04D 13/002 52/309.13
7,448,177 B2 * 11/2008 McClintick ..... E04D 1/14 52/551
8,033,072 B2 * 10/2011 McClintick ..... E04D 1/14 52/551
8,215,070 B2 * 7/2012 Railkar ..... E04D 12/004 52/173.3
8,312,685 B2 * 11/2012 Gibbs ..... E04D 1/34 52/547
8,661,760 B2 * 3/2014 Williams ..... E04D 1/34 52/547
8,677,710 B2 * 3/2014 Williams ..... E04D 1/34 52/478
8,769,903 B2 * 7/2014 Svec ..... E04C 2/205 52/551
9,097,021 B1 * 8/2015 Williams ..... E04D 1/365
9,322,174 B1 * 4/2016 Williams ..... E04D 1/34
2006/0075691 A1 * 4/2006 Verkamp ..... E04D 13/10 52/24
2011/0067339 A1 * 3/2011 Hall ..... E04D 1/34 52/543
2012/0055111 A1 * 3/2012 Fernandez Fernandez ..... E04D 1/14 52/543

* cited by examiner

ROOF PANEL SYSTEM AND HANGER METHOD FOR INSTALLATION

CROSS-REFERENCE TO RELATED APPLICATIONS

This application claims the benefit of and incorporates herein by reference U.S. Provisional Application No. 61/934,212, filed Jan. 31, 2014.

BACKGROUND OF THE INVENTION

A variety of materials and assembly methods have been used throughout history to construct roofing. Many of these building materials carry along significant disadvantages in areas such as reliability, longevity, maintenance and installation costs. There have also been significant issues associated with how these roofing materials are assembled to form a complete roof.

Natural slates have been used in roofing for centuries and can last for 50 to 100 years or more. Natural slates require vertical overlapping so the exposed part of each slate is often less than one-half the total length of the original slate piece. Such overlapping results in a roof that is heavy, often reaching weights in excess of 20 pounds per square foot. For a roofing square of a 10 by 10 foot section of roof, weights may reach around 2000 pounds per roofing square. Natural slate is expensive to purchase, difficult to install and is too heavy for most roofs on homes build today. Natural slates are difficult to manufacture and are typically narrow compared to their vertical dimension. Installers are constantly challenged by small pieces which are needed at roof areas such as hips, rakes and valleys. Many of these pieces must be fasted by special means such as custom hooks, custom hangers, specially tied wires or nails driven near areas requiring special waterproofing. These custom areas require specialized skilled labor by installers and are highly time consuming, driving up installation costs for builders.

Natural wood shingles or thicker, heavier wood shakes are expensive and sometimes require special roof construction so as to allow the roof structure to breathe. Wood roofs can have problems with algae and rot. They also can represent a significant fire hazard. This is especially true in areas with wildfires. Wood shingles and shakes are difficult to maintain in hot, dry climates. These climates can cause the wood to become brittle, crack, and become vulnerable to meteorological conditions like hail and high winds.

Clay or concrete tile roofs are heavy and often require special reinforcements so as not to collapse the roof structure. Typical clay and concrete tiles are known to absorb water, sometimes more than 3 percent by weight. This causes problems in climates that experience freezing temperatures. When absorbed water freezes, the water expands, resulting in tiles that crack and fail. This results in a short life of the roof, requiring more frequent replacement. Clay and concrete tiles often have overlapping or interlocking top and side edges. If these are damaged during installation, roof leaks can often result. These leaks are often not detected until after the roofer has left the job site. Most tile roofs require elevated wooden battens which run horizontally along the roof. These battens are usually wooden pieces such as the one by twos which are nailed flat to the roof. If a tile fails or cracks, water can penetrate to the roofing felt layer and the batten causes a dam. This built up water accumulates and can run sideways until it finds a way inside the house, typically through a nail hole. Costly water damage is the end result.

Synthetic roofing products have been developed to simulate natural material roofs such as slate or wood. Typical synthetic roofing products include cementitious, plastic, rubber, fiberglass and other composite materials. Each of these prior art synthetics has been associated with problems such as color fading, cracking, curling, peeling and other conditions which shorten the life of the roof.

Most roofing tiles and slates require nails to be driven through the product or through nail holes provided in the tiles or slates. During installation, the installer may over drive the nails resulting in a broken or damaged tile. Conversely, if the nail is under driven, a raised nail head may create a stress point on the tile above it, resulting in the tile breaking.

Natural roofing products and tiles are typically individual, narrow pieces which take time to install and fasten. These products have a joint line between each narrow, individual piece which increases the likelihood of water penetration and infiltration to the roof deck and the structure below.

Prior art roofing panels are generally designed with tongue-and-groove type design or otherwise side overlapped to accommodate water channeling between panels along their side edges. In order for the channel to be durable enough to withstand handling during installation and environmental stresses, the tile must be of increased thickness resulting in an increase of product weight on the roof. This increased thickness also reduces the architectural simulations the tile may intend. Other prior art materials include metal or steel which is stamped to include side locking channels but are limited in their intended architectural replications.

Prior art staggered length roofing products require the installer to measure and fasten each roofing piece individually to vary the length. This method is time consuming and results in high installation costs. Hangers and battens have been used to hold roofing pieces however staggered roofing pieces require that individual hangers be swapped out one by one to accommodate the different length pieces. Multiple hangers of varying sizes are required. Also hangers have been known to slip loose under conditions of high weight on the roof surface such as during high snowfall or icing events.

SUMMARY OF THE INVENTION AND DESCRIPTION OF PREFERRED EMBODIMENTS

The problems of the previously mentioned prior art are mitigated by the invention. The invention is a roof system having panels attached by battens and adjustable hangers. The hangers have a leg, a tail and a hook. The hanger is supported by a batten strip material, typically made of metal with slots. These hangers are permanently secured within the battens and are non removable once the batten is fastened to a roof deck. The hangers themselves are adjustable to different lengths by sliding them within the slot with a predetermined amount of force to accommodate staggered panel edges. This dramatically reduces the labor and costs required to install roofing panels.

The roofing panels are large, single piece panels that are preferably formed of molded clay or porcelain. Each roofing panel simulates a plurality of individual pieces of naturally appearing roofing slates, shakes or tiles. Each roofing panel may have a surface texture to simulate the functional properties of natural wood shingles, slates, or tiles or joint lines. Such functional properties include enhancing water runoff, reducing glare and improving traction for workers. The edges of each simulated piece may also extend out to different lengths, providing staggered edges. Each panel is thin, strong, lightweight and has a low rate of water absorption. Each panel has no nail holes. This lack of nail holes eliminates a potential area where leaks might otherwise occur. Also since the large panels encompass what might otherwise be several conventional tiles, there are fewer joints per given square foot or roof. This reduces areas where water might otherwise intrude.

The roofing panels are hung using a system of battens and hangers. Each batten 2 is a strip made of stainless steel or other metals. The lower and/or upper edges of each batten are mechanically stiffened to add strength. Each one is referred to as an edge stiffener 4. This stiffening may be accomplished by stamping or creating a small fold in the metal. The stiffeners both add structural strength to each batten and also act as a first stopper to keep the hangers in place.

Located in the center of each batten strip are a repeating series of horizontal slots. The slots may be formed by stamping or other known manufacturing techniques. Each batten hanger slot 8 provides a raised space where hangers may be installed. The center of each slot may be pressed down into a locking slot dimple 22. This dimple helps to keep the outer edges of the hangers separated. It also acts in part to keep the hanger 10 from sliding out of the batten 2. The slot dimple may also be hammered out by an installer. A hole 18 may also be located on each locking slot dimple 22 to aid the process of fastening battens to the wooden roof deck 32. These holes may be predrilled or pre-punched to accommodate screws, nails or other fasteners. They act as a guide or template for roofing installers to locate fasteners. The battens may be manufactured from a single long piece of sheet metal and stamped using a press to form the edge stiffeners, batten slots, locking slot dimples and holes. This makes the battens economical to manufacturing for mass production.

Each hanger 10 is typically formed from stainless steel or other metal solid wire. The wire used to form each batten is cut at regular intervals then bent to form the proper shape and convert it into a hanger. Each hanger 10 is typically installed into the slot 8 of each batten 2 at the factory.

Hangers are formed into a shape by bending the solid wire. Starting at one end of the wire, a bend is put into the wire to create a portion called the hanger tail 16. The hanger tail 16 is connected to a roughly straight portion called the short leg 20. Moving along the wire, an approximately 180 degree turn is made called the hanger radius 6. This may be made smoothly as shown in the drawings or may be made at intervals eventually coming out to approximately 180 degrees. Moving further along, another bend is made that approximately mirrors the bend that was made for the hanger tail as shown in FIG. 1*a*. The wire then continues through a roughly straight portion called the hanger leg 12 before reaching two approximately 90 degree turns in sequence that form the panel gripping portion of the invention called the hanger hook 14. It is this hanger hook 14 that directly contacts each panel edge and provides mechanical support against gravity when on the roof.

The hangers are all the same length and are typically installed within the battens at the factory. Even though the hangers are all the same length, they can slide or translate with a predetermined amount of force to accommodate staggered panel edges or to change the length of the reveal. The reveal is the length of the exposed portion of a panel or shingle on a roof. The amount of force required is determined by how tightly the batten is stamped to grip the hangers. A tighter grip results in more force required to slide the hangers for an adjustment. The hangers slide between the hanger normal position 24 and the hanger extended position 26. Intermediate positions are also possible.

To install a roofing panel, the batten strip is first fastened into the roof deck 32. Typically the hangers will all be in the hanger normal position 24. As a staggered roof panel 34 is introduced, the installer will press the edges of the panel into the hanger hook 14 portions of the hangers. There are staggered roof panel short edges 38 and there are protruding staggered roof panel long edges 36. As the installer slides the panel into the hangers, the hangers will slide or translate to accommodate the long and short edges. Hangers supporting the staggered roof panel short edges 38 will remain in the hanger normal position 24 while the hangers supporting the protruding staggered roof panel long edges 36 will slide to the hanger extended position 26 as the installer applies some pressure. This process is repeated for the whole roof. This method allows for the rapid installation of staggered roof panels without the need to replace or switch out hangers.

As a hanger is slid for adjustment within the batten slot, it is kept from sliding out of the batten past the extended position 26 by several mechanical contact points. The locking slot dimple 22 provides a mechanical stop for the hanger radius 6. An edge stiffener 4 provides a mechanical stopping point for the hanger tail 16. The roofing fastener 28 also provides a mechanical stopping point for the hanger radius 6 once it has been installed through the batten hole 18. The hangers are non-removable from the batten slot.

The hangers are preinstalled within the battens. Once a fastener is used to secure the battens to the roof deck 32, the roofing fastener 28 makes them permanently non-removable. The hanger radius 6 is unable to pass through the secured roofing fastener 28. This is advantageous since prior art hanger systems had hangers that could sometimes inadvertently be completely dislodged from the battens due to high loading such as ice or snow. The prior art hangers were designed to be removable so that different length hangers could be installed. The invention only uses one size hanger and different length hangers are not required since one size of hanger can slide or translate to different lengths. The invention allows for increased safety and lower maintenance due to this more secure attachment.

Since each panel represents a plurality of individual slates or shingles, labor normally required to deal with roof details such as rake edges, hips and valleys is reduced when compared to the prior art. Normally working with prior art non asphalt roofing requires working with small pieces of individual shingles or small pieces of slate or tile. These individual shingles are tricky to configure and it is difficult to anchor them. With the invention, a panel can simply be cut to accommodate the space and then hung on the hangers. This eliminates small pieces and custom hanging solutions normally required at the roof details. No special custom anchoring solutions are required, reducing labor costs.

It is at times beneficial to use an interlayment 46 or underlayment 30 layered between and/or underneath the panels so that any water passing through the side edges of the panels runs off. Durable materials for interlayments or underlayments include various synthetic materials including felt paper, rubberized materials and UV stabilized high density polyethylene.

Roof panels may have a grooved or rough edge 40 on the portions of the panel that come in contact with the hanger hook 14. These grooves help the hangers to mechanically interface with and grip the panels. They also act to prevent sliding of the panels sideways and act to help hide the hangers when viewed at a distance. The entire hanger 10 or just the hanger hook 14 may optionally have a coating material applied over it. Such coatings include commercially available rubberized urethane or power coatings. The coating materials act to further help the hangers to mechanically interface with and grip the panels. They also may act to prevent sliding of the panels sideways and act to help hide the hangers when viewed at a distance.

Alternative Embodiments

There are a number of other ways the invention can be implemented, some examples:

- The invention may be used in roofing and/or siding applications.
- The roofing panels may be constructed from a variety of materials.
- The hangers may be made from plastics, composites or other materials
- The battens may be made from plastics, composites or other materials
- The hangers and/or battens may be made from stainless steel, steel, iron, galvanized steel or other metals
- The roof panels may be shaped in a variety of different shapes and/or lengths and/or ratios of height to width.
- The roof panels may be staggered or unstaggered.
- The roof panel edges may have rough edges, grooves or a smooth surface.
- The hanger at batten system described may be used with existing roofing tiles, shingles, slates and other roofing units.
- The patterns, textures or divisions on each roofing panel may vary.
- The sizes and distance between batten slots may vary.
- The battens may have holes pre-installed or holes not present.
- The slot dimple may be made at the factory, may be added by an installer with a tool or may not be present.
- The sizes of hangers may vary.
- The distance over which a hanger may slide to be adjustable may vary.
- The hangers may be made as pre-installed at the factory or may be installed by the end user later.
- The adjustable hangers may be permanently installed in the battens or removable.
- The exact position of bends on a hanger may vary.
- Bends in the hanger may take place in multiple small bends instead of one large bend.
- The hanger radius may be a smooth curve or make the approx 180 degree turn via multiple small bends.
- The material used for the roof deck may be wood or other materials used for roof decks.
- The invention may also be used for the installation of siding.
- The coating applied may include any commercially available coatings or paints intended to coat the hanger material
- The portions of the hanger coated may include the entire hanger, just the hanger hook, the regions around the slot or any portion of the hanger

Figure 1:
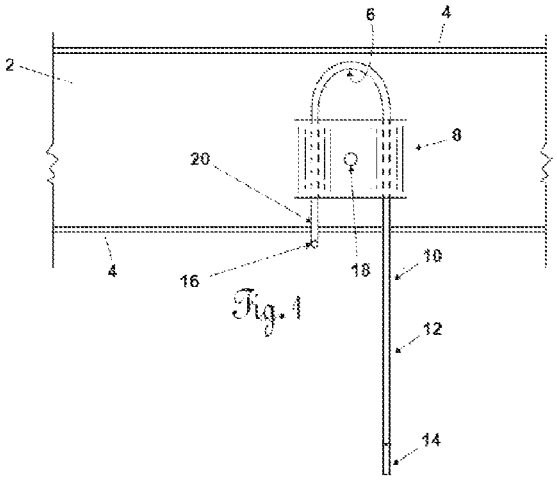
FIG. 1 is a top view of the invention showing a batten 2 with a hanger 10 installed.
Figure 1A:
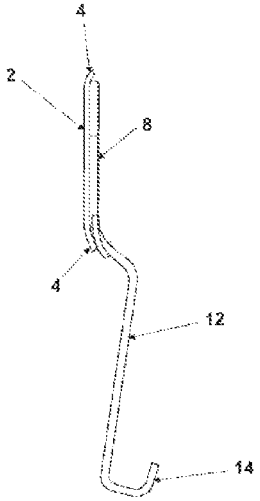
FIG. 1*a* is a left side view of the invention shown in FIG. 1 showing the hanger hook 14 and hanger leg 12. The two edge stiffeners 4 of the batten 2 are also shown holding the hanger in place by tension along with the batten hanger slot 8.
Figure 1B:
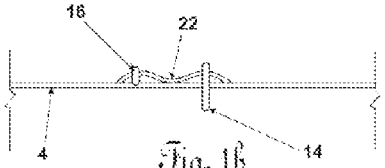
FIG. 1*b* is a lower side view of the invention shown in FIG. 1. This view shows an edge stiffener 4 along with the locking slot dimple 22. The hanger hook 14 and hanger leg 12 are also shown.
Figure 2:
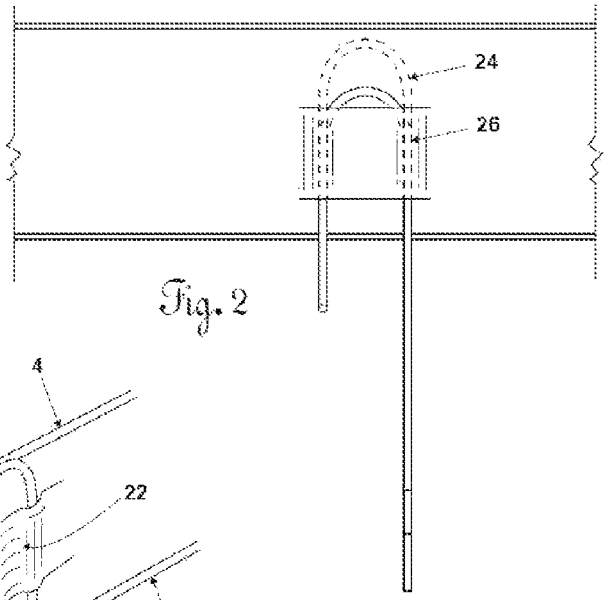
FIG. 2 is a top view of the invention showing the hanger normal position 24 (in dotted lines) and the hanger extended position 26. This view illustrates how the hanger can be slid downwards to change positions.
Figure 2B:
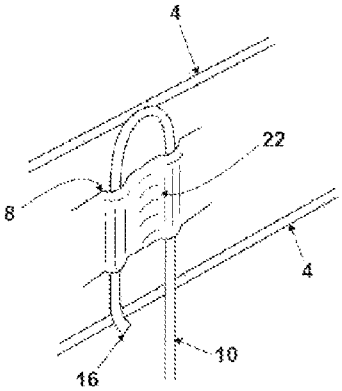
FIG. 2*b* is a perspective view showing a hanger 10 installed within a batten hanger slot 8. The locking slot dimple 22 can be seen in this figure. This slot dimple helps keep the hanger from sliding too far downwards.
Figure 2A:
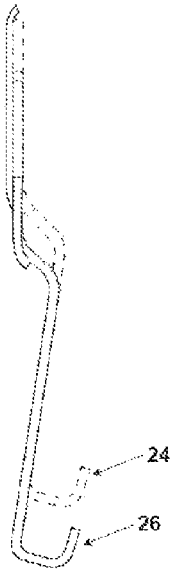
FIG. 2*a* is a left side view of the hanger normal position 24 (in dotted lines) and the hanger extended position 26. This view illustrates how the hanger can be slid downwards to change positions.
Figure 3:
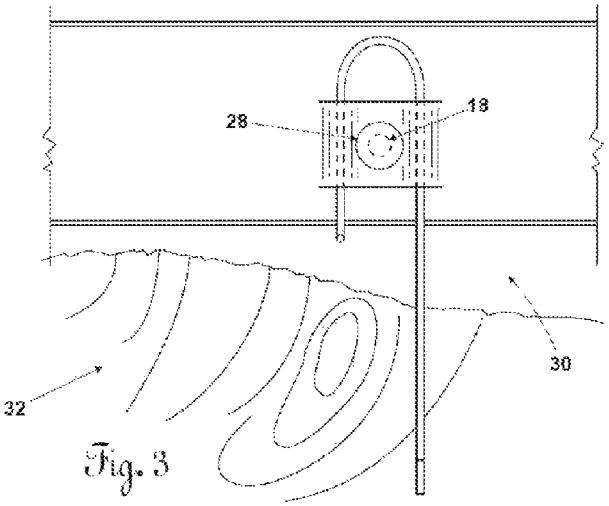
FIG. 3 is a top view of the invention from FIG. 1 fastened to a typical roof deck system. The hole 18 is shown (in dotted lines) after having a roofing fastener 28 placed through it to secure it. The roofing fastener 28 pierces through a layer of underlayment 30 and into the wooden roof deck 32.
Figure 3A:
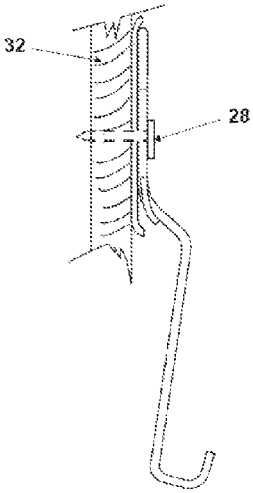
FIG. 3*a* shows a left side view of the scene from FIG. 3. A roofing fastener 28 in shown anchored to the wooden roof deck 32.
Figure 3B:
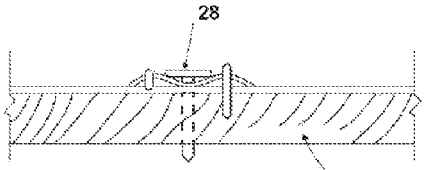
FIG. 3*b* shows a lower side view of the scene from FIG. 3. A roofing fastener 28 is shown anchored to the wooden roof deck 32.
Figure 4:
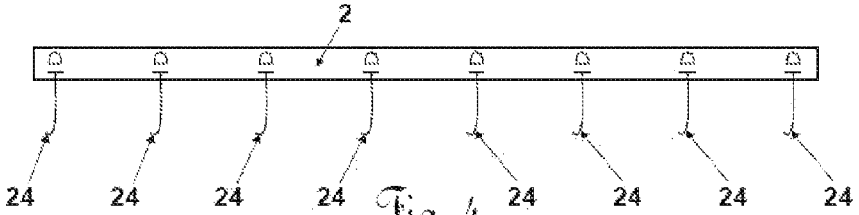
FIG. 4 shows a top view of a strip of the stainless steel batten 2. Multiple hangers are shown in the hanger normal position 24. This configuration is how an installer might first receive the invention from the factory.
Figure 4A:
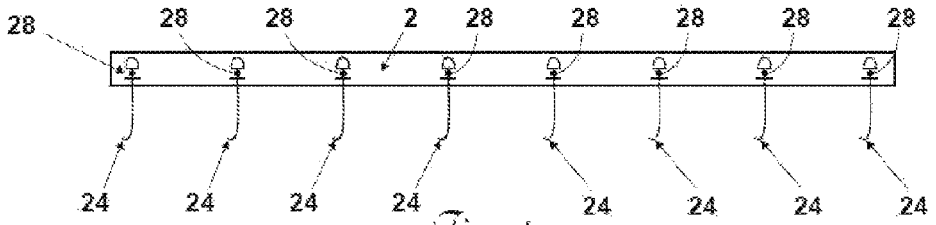
FIG. 4*a* shows a top view of a strip of the stainless steel batten 2. Multiple roofing fasteners 28 are shown piercing through the batten 2. Multiple hangers are shown still in the hanger normal position 24.
Figure 4B:
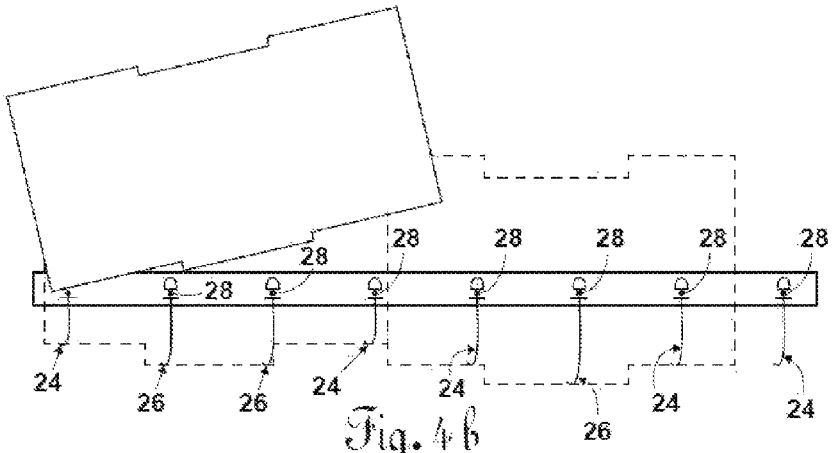
FIG. 4*b* shows a top view of the same scene from FIG. 4*a* with a staggered roof panel in the process of installation. Hangers that will support the protruding (Long edge) portions of the staggered roof panel are shown in the hanger extended position 26 to accommodate and support the panel going in. Other hangers are shown in the hanger normal position 24 to accommodate and support other (Short edge) areas of the panel.
Figure 5:
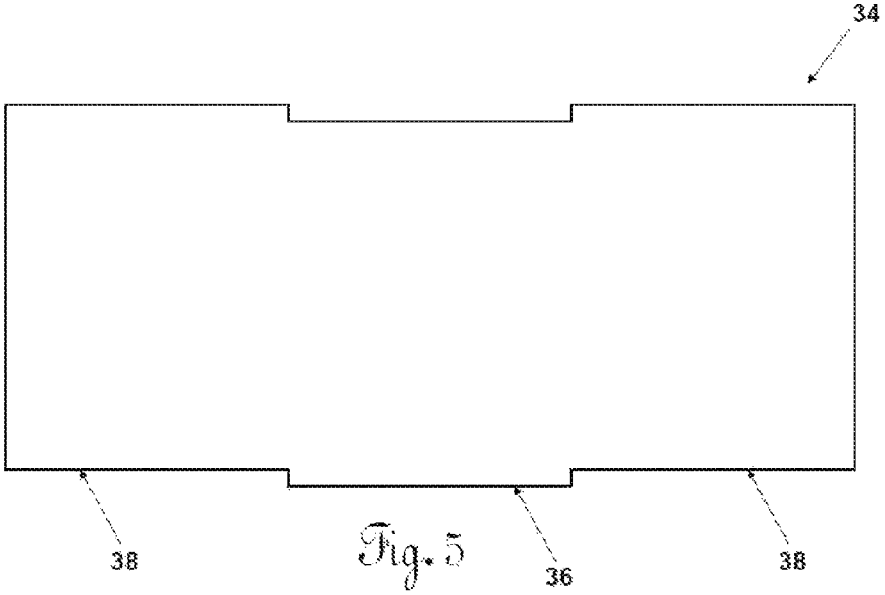
FIG. 5 is a top view of a staggered roof panel 34. The staggered roof panel long edge 36 along with instances of the staggered roof panel short edge 38.
Figure 6:
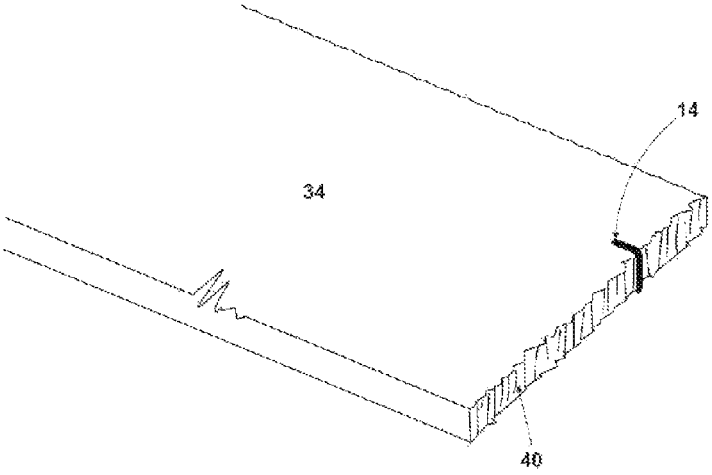
FIG. 6 shows a perspective view of a portion of a staggered roof panel 34. The roof panel is shown with a grooved or rough edge 40 which mechanically interfaces with a hanger hook 14. This helps prevent sliding and also helps to hide the hanger hook 14.
Figure 6A:
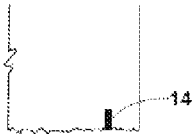
FIG. 6*a* shows a top view of a portion of the scene from FIG. 6. The hanger hook 14 can be seen.
Figure 6B:
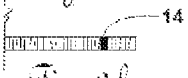
FIG. 6*b* shows the lower side of a portion of the scene from FIG. 6. The hanger hook 14 can be seen.
Figure 7:
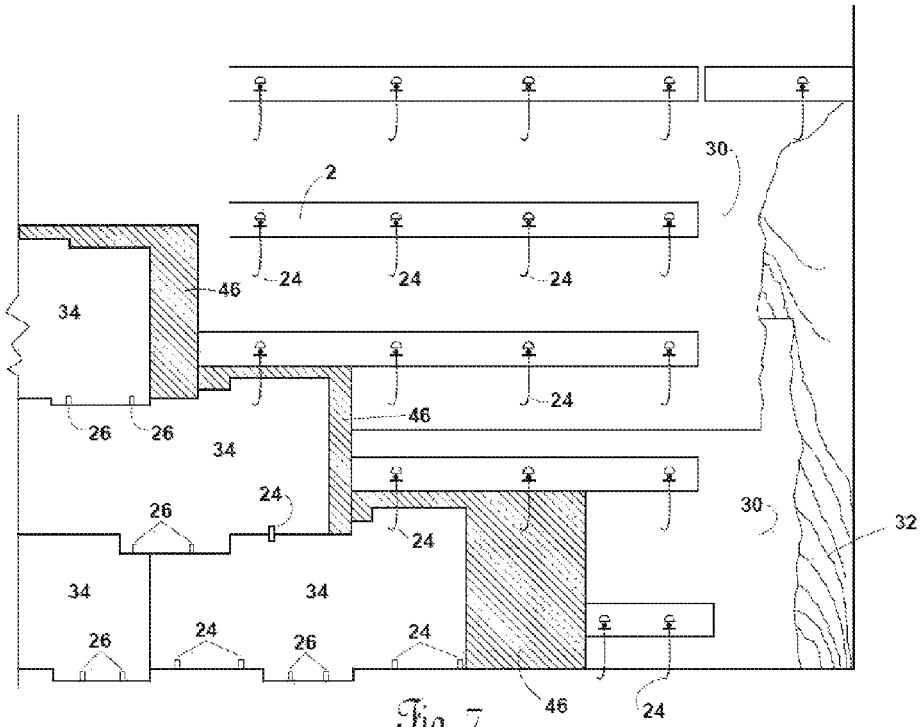
FIG. 7 shows a top view of the invention being installed on a roof. Multiple examples of the staggered roof panel 34 are shown. The hangers are moved to the appropriate position to accommodate the staggered edges, either the hanger normal position 24 or the hanger extended position 26. The hangers themselves are supported by multiple instances of the batten 2. Waterproof interlayment material 46 is shown installed underneath the staggered roof panels.

Waterproof underlayment material 30 is shown installed underneath the battens 2. Everything is affixed to the wooden roof deck 32.

SUMMARY OF PARTS LABELED IN DRAWINGS

2 Stainless Steel Batten
4 Edge Stiffener
6 Hanger Radius
8 Batten Hanger Slot
10 Hanger
12 Hanger Leg
14 Hanger Hook
16 Hanger Tail
18 Hole
20 Short Leg
22 Locking Slot Dimple
24 Hanger Normal Position
26 Hanger Extended Position
28 Roofing Fastener
30 Underlayment
32 Wooden Roof Deck
34 Staggered Roof Panel
36 Staggered Roof Panel Long Edge
38 Staggered Roof Panel Short Edge
40 Rough Edge
46 Interlayment

The invention claimed is:

1. A system for roofing or siding comprising:

a) a multiplicity of panels;

b) a multiplicity of hangers, each comprising at least one hanger hook on a first end and further comprising a second end that has been curved back around to be substantially parallel to the first end forming a curved section between the first and second ends and a parallel section between the curved section and the first and second ends;

c) at least one batten containing a multiplicity of hanger slots;

wherein said hanger slots are each comprising at least two substantially adjacent openings formed in the batten, leaving a center strip of the batten positioned between the openings;

further wherein said openings are capable of receiving said hangers such that the hanger slides through the openings leaving a portion of the parallel section of the hanger behind the center strip of the batten, thereby causing the center strip of the batten to at least partially curve outward, and leaving the curved section of the hanger above said openings and the at least one hanger hook below the said openings;

further wherein said hangers translate along the length of the parallel section of the hanger within said hanger slots allowing the hanger hook position to be adjustably extended or shortened in distance relative to the batten in two or more positions without needing to replace said hangers to accommodate a panel of different or varying length;

further wherein the at least one batten is fastened to a target surface at a first location using at least one batten fastener to form at least a first batten row; and wherein the lowest edge of the said panels in said first batten row is set in said hanger hooks of said first batten row.

2. The system of claim 1, wherein an edge of said panels comprises at least two substantially parallel but not collinear sections, thereby creating the visual illusion of multiple smaller panels which are physically staggered.

3. The system of claim 2, wherein any of said hangers are extended at different distances relative to the batten within said hanger slots to accommodate said panel edge.

4. The system of claim 1, wherein any of said hangers are extended at different distances relative to the batten within said hanger slots to accommodate changing a length of the exposed portion of said panels.

5. The system of claim 1, further comprising a locking slot dimple, wherein said locking slot dimple is comprised of a depression formed into the center strip of the batten such that the parallel section of the hanger is at least partially engaged to retain said hangers within said hanger slots.

6. The system of claim 1, further comprising at least one hole in the center strip of the batten capable of receiving at least one of said at least one batten fasteners, wherein the at least one batten fastener will urge the center strip of the batten against the parallel section of the hanger for retaining said hangers within the hanger slots of said batten and giving the hanger mechanical support.

7. The system of claim 1, wherein said panels further comprise a surface texture to simulate the functional properties of multiple natural wood shingles, slates, or tiles or joint lines.

8. The system of claim 1, wherein said hangers are all of one common size.

9. The system of claim 1, wherein said panels further comprise a textured or grooved edge so as to mechanically interface with said hangers.

10. The system of claim 1, wherein said hangers are partially or fully coated with a friction enhancing coating, wherein the friction enhancing coating is selected from the group consisting of rubberized urethane coating or powder coating.

11. The system of claim 1, wherein said hangers are non-removable from said hanger slots and wherein any of said hangers are extended at different distances relative to the batten from said hanger slots to accommodate a staggered panel edge within a row of panels.

12. The system of claim 1, wherein:

a) an edge of said panels comprises at least two substantially parallel but not collinear sections, thereby creating the visual illusion of multiple smaller panels which are physically staggered, b) any of said hangers are extended at different distances relative to the batten within said hanger slots to accommodate said panel edge, and c) said panels have a surface texture to simulate the functional properties of multiple natural wood shingles, slates, or tiles or joint lines.

13. The system of claim 1, wherein:

a) an edge of said panels comprises at least two substantially parallel but not collinear sections, thereby creating the visual illusion of multiple smaller panels which are physically staggered, b) any of said hangers are extended at different distances relative to the batten within said hanger slots to accommodate said panel edge, and c) said system further comprising a locking slot dimple, wherein said locking slot dimple is comprised of a depression formed into the center strip of the batten such that the parallel section of the hanger is at least partially engaged to retain said hangers within said hanger slots.

14. The system of claim 1, wherein:

a) an edge of said panels comprises at least two substantially parallel but not collinear sections, thereby creating the visual illusion of multiple smaller panels which are physically staggered, b) any of said hangers are extended at different distances relative to the batten within said hanger slots to accommodate said panel edge, c) said panels have a surface texture to simulate the functional properties of multiple natural wood shingles, slates, or tiles or joint lines, d) said system further comprising a locking slot dimple, wherein said locking slot dimple is comprised of a depression formed into the center strip of the batten such that the parallel section of the hanger is at least partially engaged to retain said hangers within said hanger slots, and e) said batten further comprises at least one hole in the center strip of the batten capable of receiving at least one of said at least one batten fasteners, wherein the at least one batten fastener will urge the center strip of the batten against the parallel section of the hanger for retaining said hangers within the hanger slots of said batten and giving the hanger mechanical support.

15. The system of claim 1, wherein:

a) an edge of said panels comprises at least two substantially parallel but not collinear sections, thereby creating the visual illusion of multiple smaller panels which are physically staggered, b) any of said hangers are extended at different distances relative to the batten within said hanger slots to accommodate said panel edge, c) said panels have a surface texture to simulate the functional properties of multiple natural wood shingles, slates, or tiles or joint lines, d) said system further comprising a locking slot dimple, wherein said locking slot dimple is comprised of a depression formed into the center strip of the batten such that the parallel section of the hanger is at least partially engaged to retain said hangers within said hanger slots, and e) said batten further comprises at least one hole in the center strip of the batten capable of receiving at least one of said at least one batten fasteners, wherein the at least one batten fastener will urge the center strip of the batten against the parallel section of the hanger for retaining said hangers within the hanger slots of said batten and giving the hanger mechanical support, and f) said hangers are all of one common size.

16. The system of claim 1, wherein:

a) an edge of said panels comprises at least two substantially parallel but not collinear sections, thereby creating the visual illusion of multiple smaller panels which are physically staggered, b) any of said hangers are extended at different distances relative to the batten within said hanger slots to accommodate said panel edge, c) said panels have a surface texture to simulate the functional properties of multiple natural wood shingles, slates, or tiles or joint lines, d) said system further comprising a locking slot dimple, wherein said locking slot dimple is comprised of a depression formed into the center strip of the batten such that the parallel section of the hanger is at least partially engaged to retain said hangers within said hanger slots, and e) said batten further comprises at least one hole in the center strip of the batten capable of receiving at least one of said at least one batten fasteners, wherein the at least one batten fastener will urge the center strip of the batten against the parallel section of the hanger for retaining said hangers within the hanger slots of said batten and giving the hanger mechanical support, f) said hangers are all of one common size, g) said panels further comprise a textured and/or grooved edge so as to mechanically interface with said hangers, and h) said hangers are non-removable from said hanger slots.

17. The system of claim 1, wherein said panels are constructed from a material comprising molded clay or porcelain.

18. The system of claim 1, wherein said at least one batten is constructed from a material comprising stainless steel and other metals possessing the characteristics of strength and durability.

19. The system of claim 1, further comprising an underlayment positioned beneath the batten, wherein the underlayment is constructed from a material comprising felt paper, rubberized materials, UV stabilized high density polyethylene and other synthetic materials.

20. The system of claim 1, wherein:

a) an edge of said panels comprises at least two substantially parallel but not collinear sections, thereby creating the visual illusion of multiple smaller panels which are physically staggered, b) any of said hangers are extended at different distances relative to the batten within said hanger slots to accommodate said panel edge, c) said panels have a surface texture to simulate the functional properties of multiple natural wood shingles, slates, or tiles or joint lines, d) said system further comprising a locking slot dimple, wherein said locking slot dimple is comprised of a depression formed into the center strip of the batten such that the parallel section of the hanger is at least partially engaged to retain said hangers within said hanger slots, and e) said batten further comprises at least one hole in the center strip of the batten capable of receiving at least one of said at least one batten fasteners, wherein the at least one batten fastener will urge the center strip of the batten against the parallel section of the hanger for retaining said hangers within the hanger slots of said batten and giving the hanger mechanical support, f) said hangers are all of one common size, g) said panels further comprise a textured and/or grooved edge so as to mechanically interface with said hangers, h) said hangers are non-removable from said hanger slots, and i) said system further comprising an underlayment positioned beneath the batten.

* * * * *